US006971911B2

(12) United States Patent
Ramsey et al.

(10) Patent No.: US 6,971,911 B2
(45) Date of Patent: Dec. 6, 2005

(54) ADAPTABLE ELECTRICAL WORKSTATION MODULE

(75) Inventors: Mark E. Ramsey, Fort Wayne, IN (US); Kenneth H. Lubkert, Fort Wayne, IN (US)

(73) Assignee: Pent Technologies, Inc., Kendallville, IN (US)

( * ) Notice: Subject to any disclaimer, the term of this patent is extended or adjusted under 35 U.S.C. 154(b) by 0 days.

(21) Appl. No.: 10/685,007

(22) Filed: Oct. 14, 2003

(65) Prior Publication Data

US 2004/0090157 A1 May 13, 2004

Related U.S. Application Data

(60) Provisional application No. 60/418,529, filed on Oct. 15, 2002.

(51) Int. Cl.[7] ..... H01R 13/73
(52) U.S. Cl. ..... 439/574; 439/535; 248/231.71
(58) Field of Search ..... 439/574, 535, 439/131, 532; 174/58; 248/214, 231.7, 226.11, 248/230.9, 241, 254

(56) References Cited

U.S. PATENT DOCUMENTS 4,654,756 A 3/1987 Wilson et al. ..... 361/428
5,057,039 A 10/1991 Persing et al. ..... 439/574
5,501,614 A * 3/1996 Tsuchiya ..... 439/574
D408,355 S 4/1999 Welsh et al. ..... D13/139.4
5,954,525 A 9/1999 Siegal et al. ..... 439/131
5,964,618 A * 10/1999 McCarthy ..... 439/574
6,004,157 A 12/1999 Glass ..... 439/574
6,042,426 A 3/2000 Byrne ..... 439/654
6,200,159 B1 3/2001 Chou ..... 439/535
D444,126 S 6/2001 Chura et al. ..... D13/139.8
6,243,257 B1 6/2001 Ester ..... 361/625
6,379,182 B1 4/2002 Byrne ..... 439/574
6,717,053 B2 * 4/2004 Rupert ..... 439/574

* cited by examiner

*Primary Examiner*—Briggitte R. Hammond
(74) *Attorney, Agent, or Firm*—Taylor & Aust, P.C.

(57) ABSTRACT

A workstation assembly including a worksurface having opposite sides and an electrical workstation module. The electrical workstation module includes a housing with a mounting surface adjacent one side of the worksurface, at least one modular electrical component carried by the housing, an adjustment element connected to the housing and a bracket connected with the adjustment element. The bracket has a compressive surface adjacent an other side of the worksurface and that faces the mounting surface. The compressive surface is movable in directions toward and away from the mounting surface using the adjustment element.

19 Claims, 5 Drawing Sheets

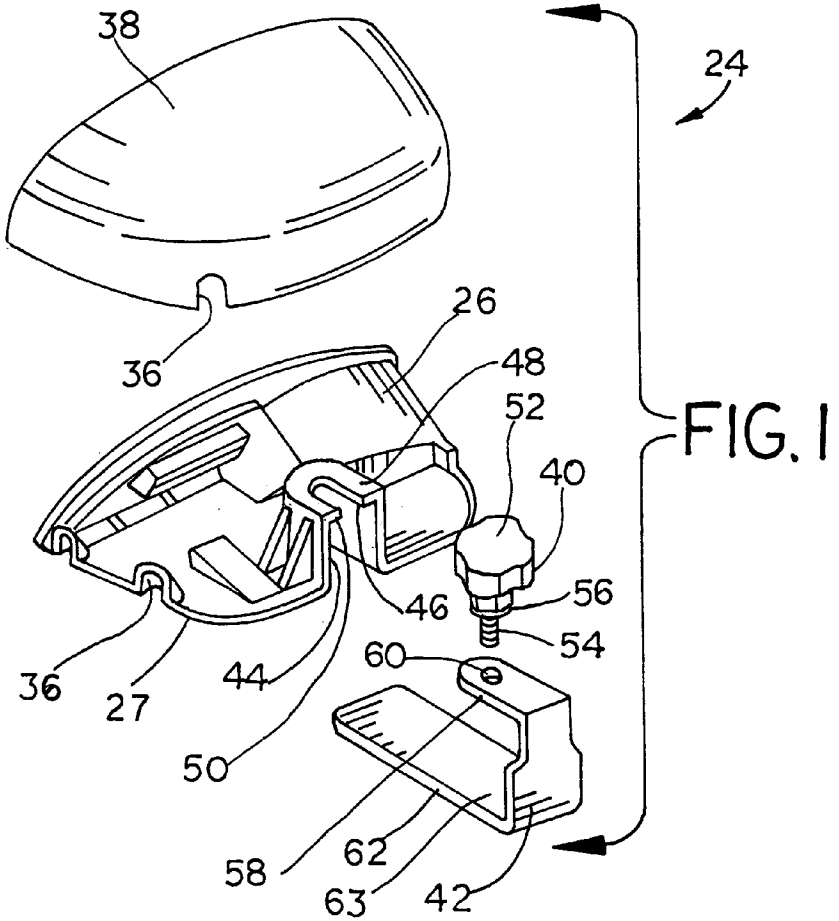
FIG. 1
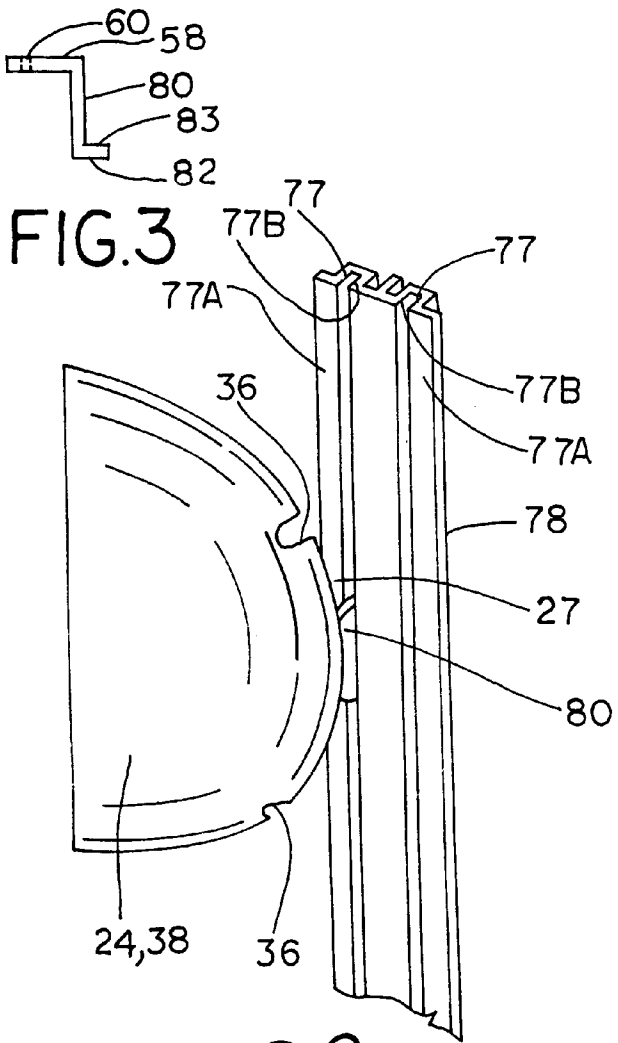
FIG. 3
FIG. 2

ADAPTABLE ELECTRICAL WORKSTATION MODULE

CROSS REFERENCE TO RELATED APPLICATIONS

This is a non-provisional application based upon U.S. provisional patent application Ser. No. 60/418,529, entitled "ADAPTABLE WORK SURFACE MODULE", filed Oct. 15, 2002.

BACKGROUND OF THE INVENTION

1. Field of the Invention

The present invention relates to electrical workstation modules that provide modular electrical components, and, more particularly, to electrical workstation modules that provide modular electrical components and that can be adapted to an existing workstation without changing the configuration of the workstation.

2. Description of the Related Art

Efficient organization of devices requiring electrical power within an office, commercial, industrial or residential environment has been exacerbated by the proliferation of additional devices for lighting, communications such as complex telephone stations, modems and facsimile machines, computers and computer peripherals such as video displays, printers and the like. A primary problem associated with the efficient organization and use of such devices relate to the abundance of communication and power wiring arrays and the positioning thereof within a workstation environment.

Telephone terminals and electrical receptacles have long been used for providing convenient, floor-level interconnection nodes for connecting telephones, computers and other electrical devices to the communications, data networks and electrical networks. These types of communications and electrical networks have proliferated particularly with the advances in communications, computers and related equipment. Many commercial, industrial, educational and residential environments now have a variety of communication networks. Many of the networks are internal and many are connected to external networks, such as telephone lines. These networks now include dedicated communication lines, video communications, computer networks, and fiber optics communication lines for various types of information.

A long-standing problem has been the efficient interconnection of these communications networks with the end use devices, such as telephones and computers. This is especially difficult in an office environment where it is desirable to eliminate tangled wiring arrays for both aesthetic and safety reasons. Many offices have numerous wires running from each desk to wall-mounted data terminals for telephone, computer and other information and communication networks.

The problem of tangled wires in the office environment is even more pronounced when electrical power wiring is added to the tangle of communications wires. Wiring costs can be relatively high if a sufficient number of terminals and receptacles are not utilized and properly positioned. However, the cost of the materials also rapidly increases as the number of receptacles is increased. In addition, and perhaps more importantly, the conventional design of terminals within wall or floor services, which are often a substantial distance from devices such as those employed on work surfaces (computer terminals, etc.), can cause relatively unsightly and sometimes dangerous wiring arrays, in addition to resultant entanglements of cords connected to these devices.

Another problem is that existing communications and power receptacles may not be available as electrical and electronic devices are added, simply due to all available existing receptacles being used.

Outlet assemblies are known that provide electrical and communication outlets, however, such assemblies are limited to a single mounting method respective to the workstation.

Other assemblies are known that provide electrical and communication outlets and which clamp to a worksurface, however, such assemblies are limited to a single mounting method respective to the workstation and also have a fixed bracket requiring a movable clamping device which is mounted on the underneath of the worksurface. Such a clamping device underneath of the worksurface is inconvenient due to possible bumping of knees, legs, etc. Further, such mounting is typically unattractive. Known clamping devices are typically threaded elements with a fairly small surface area in contact with the worksurface and are prone to damaging the worksurface when overtightened, or even moderately tightened.

What is needed in the art is an electrical workstation module that is mountable to a variety of workstation environments and in a variety of mounting methods, that does not obstruct ingress or egress respective to a person using a workstation, that does not damage the worksurface and that is aesthetically appealing, while providing access to modular electrical components, such as receptacles, conveniently.

SUMMARY OF THE INVENTION

The present invention provides an adaptable electrical workstation module with a movable bracket.

The invention comprises, in one form thereof, a workstation assembly, comprising: a worksurface having opposite sides and an electrical workstation module. The electrical workstation module includes a housing with a mounting surface adjacent one side of the worksurface, at least one modular electrical component carried by the housing, an adjustment element connected to the housing and a bracket connected with the adjustment element. The bracket has a compressive surface adjacent an other side of the worksurface and that faces the mounting surface. The compressive surface is movable in directions toward and away from the mounting surface using the adjustment element.

An advantage of the present invention is an electrical workstation module that is mountable to a variety of worksurface environments.

Another advantage of the present invention is an electrical workstation module that is mountable in a variety of mounting methods.

Yet another advantage of the present invention is an electrical workstation module that does not obstruct ingress or egress respective to a person using a workstation.

A further advantage of the present invention is an electrical workstation module that is aesthetically appealing.

A further advantage of the present invention is an electrical workstation module that is mountable on a table edge where the edge is essentially square, or on a table edge that has a sloped upper surface typically called a waterfall edge or associated with a cutout in a worksurface.

A further advantage of the present invention is an electrical workstation module, when mounted, that has no hardware exposed under the table.

A further advantage of the present invention is an electrical workstation module which is easier to secure to a worksurface with the tightening knob located above the worksurface and therefore easily accessible.

A further advantage of the present invention is an electrical workstation module that can be mounted to a slotted rail.

A further advantage of the present invention is an electrical workstation module that can be mounted to a perforated rail.

A further advantage of the present invention is an electrical workstation module that does not damage the worksurface.

A further advantage of the present invention is an electrical workstation module that provides convenient access to modular electrical components such as receptacles.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 1 is an exploded perspective view of an embodiment of a worksurface module of the present invention;

FIG. 2 is a perspective assembled view of the module of the present invention shown in a slotted mounting;

FIG. 3 is a side view of an embodiment of a bracket of the present invention as would be used in FIG. 2;

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 7:
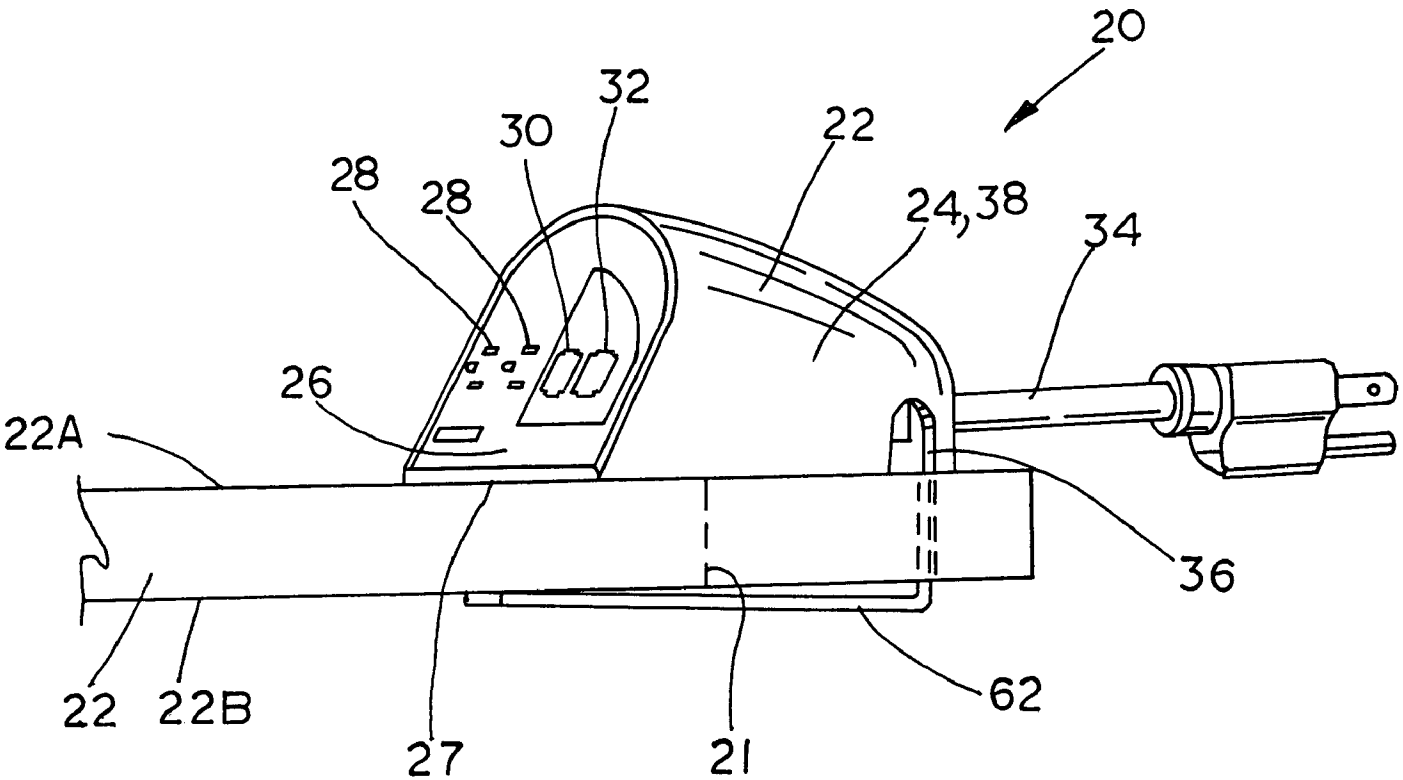
FIG. 7 is a perspective assembled view of the module of FIG. 1 shown mounted on a worksurface in a through hole in the worksurface.
Figure 9:
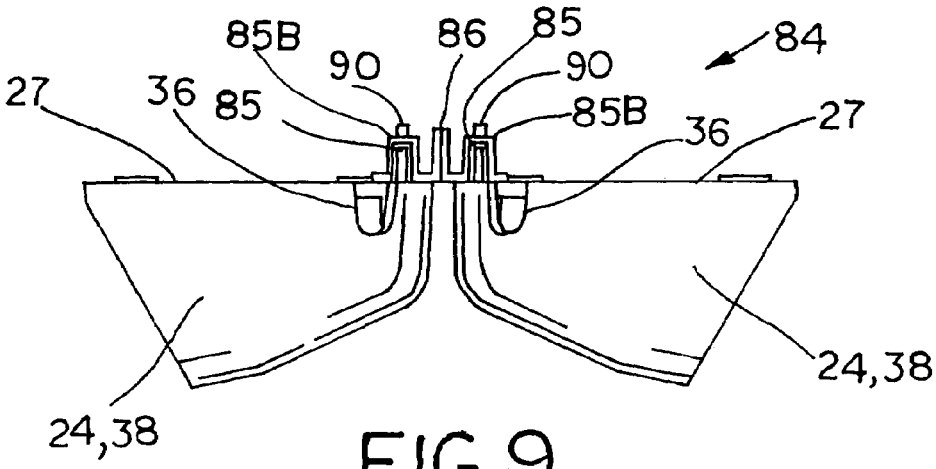
FIG. 9 is a top view of FIG. 8.

Referring now to the drawings, and more particularly to FIGS. 1 and 7, there is shown workstation assembly 20 which generally includes through hole 21 in worksurface 22 and electrical workstation module 24. Worksurface 22 has opposite sides 22A and 22B Electrical workstation module 24 includes housing 26 with mounting surface 27 adjacent side 22A. Housing 26 carries at least one modular electrical component such as power receptacle 28, data receptacle 30 and telephone receptacle 32. Electrical connection can be made to electrical workstation module 24 by cable connection such as power cable 34. Telephone and data cables can be connected to corresponding receptacles through aperture 36. Electrical workstation module 24 can include cover 38 that protects internal connections and provides an aesthetic look, and that alternatively can be part of housing 26. Electrical workstation module 24 further includes adjustment element 40 connected to movable bracket 42 and shaped slot 44. Shaped slot 44 includes collar 46 with collar top side 48 and collar bottom side 50.

Adjustment element 40 includes knob 52 connected to threaded element 54 that is connected to flange 56. When adjustment element 40 is assembled with housing 26, knob 52 rests on collar top side 48. Slot collar 46 is interposed between knob 52 and flange 56 thereby allowing rotation of adjustment element 40 while restricting translation thereof.

Movable bracket 42 includes shaped segment 58 having threaded hole 60 therein. Compressive segment 62 is opposed from and connected to shaped segment 58. Compressive segment 62 includes compressive surface 63 adjacent side 22B. Shaped segment 58 can be complimentary in shape to shaped slot 44. When assembled, shaped segment 58 is disposed within shaped slot 44 and threaded onto threaded element 54. When mounted, worksurface 22 is between the mounting surface 27 and compressive segment 62. Rotation of knob 52 adjusts movable bracket 42 in shaped slot 44 allowing electrical workstation module 24 to adapt to a variety of worksurfaces.

Figure 5:
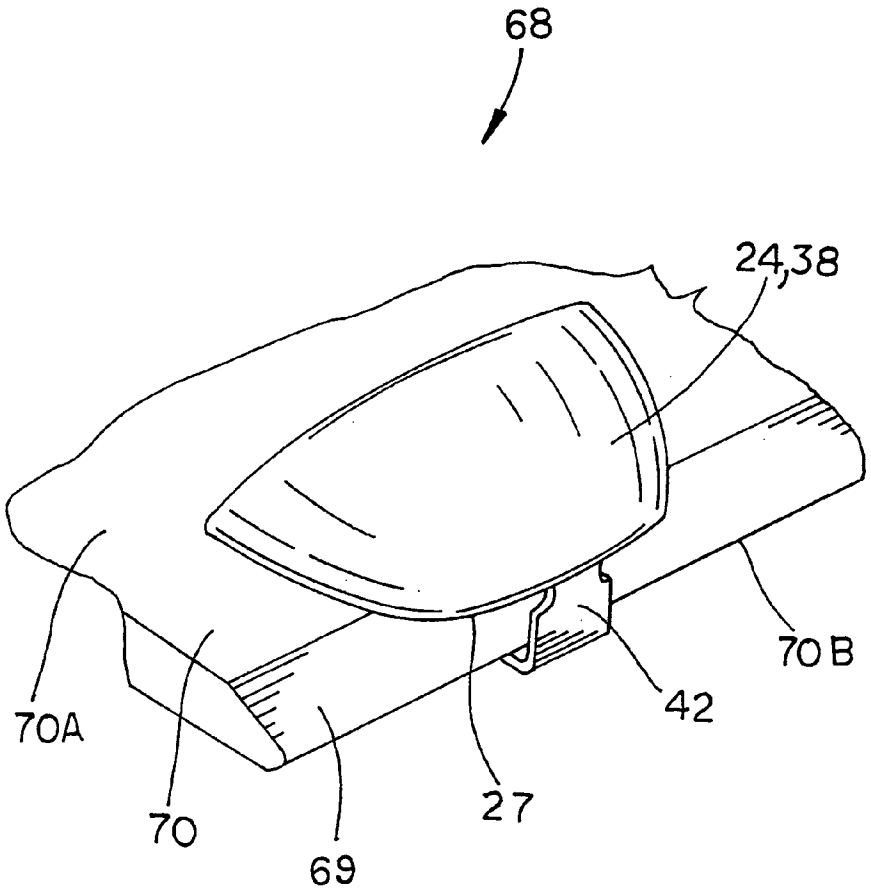
FIG. 5 is a perspective view of the module of FIG. 1 shown mounted on a worksurface that has a waterfall edge.
Figure 4:
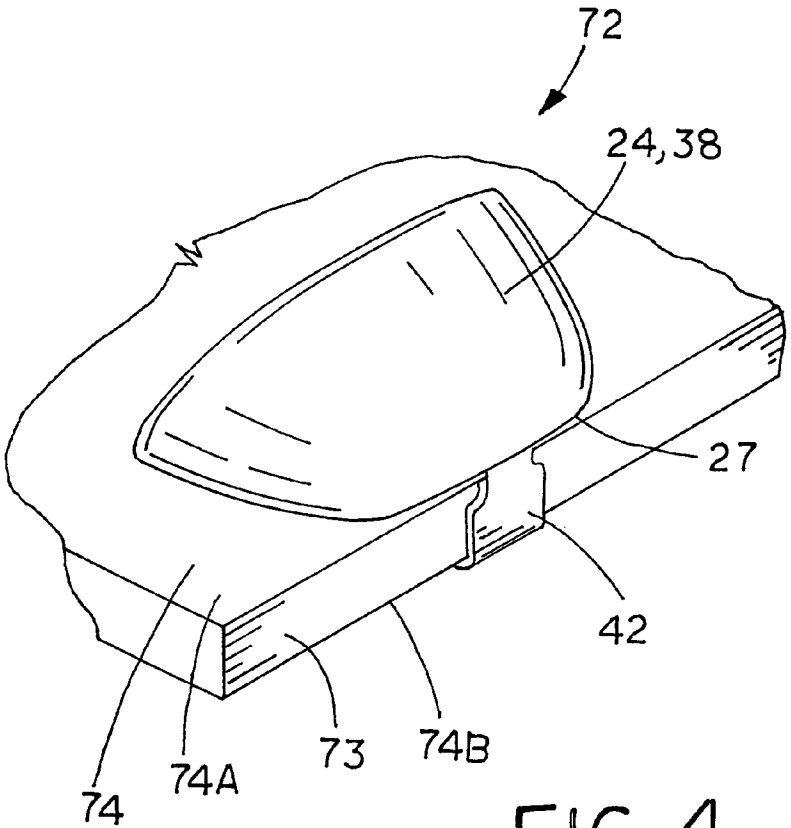
FIG. 4 is a perspective view of the module of FIG. 1 shown mounted on a worksurface that has an abrupt edge.
Figure 6:
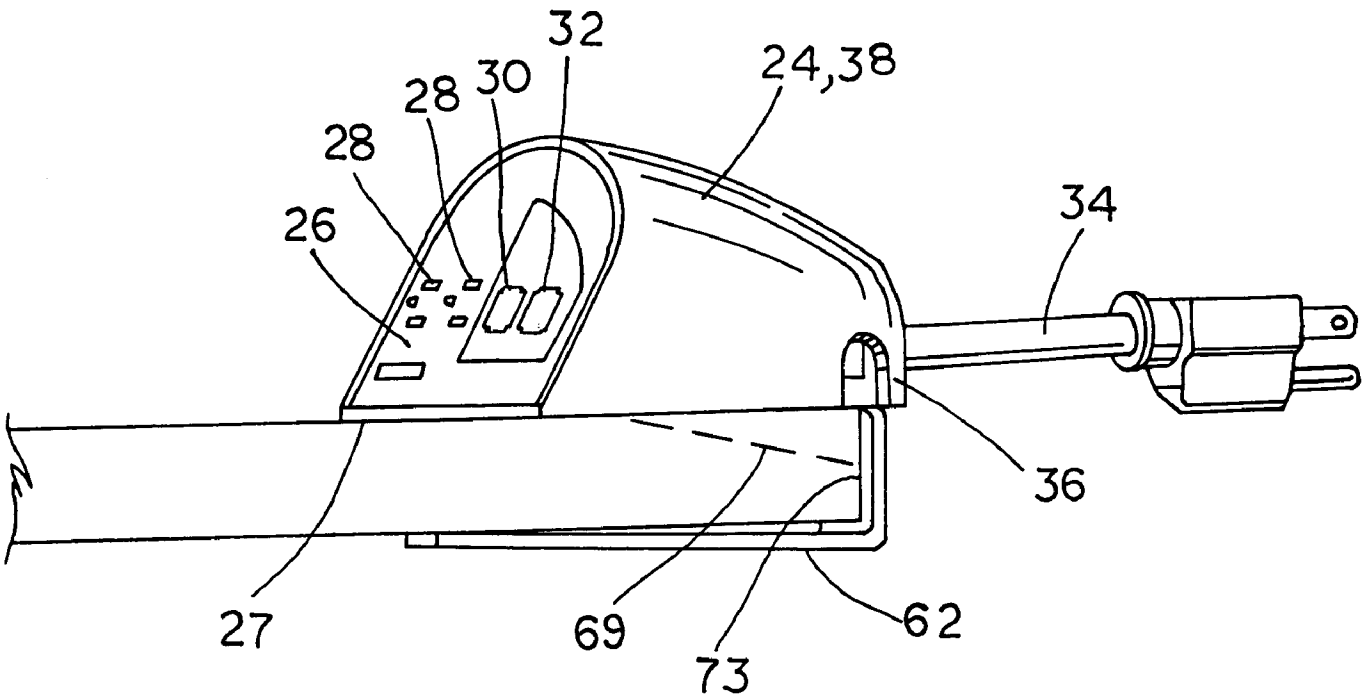
FIG. 6 is a side view of the module of FIG. 1 shown mounted on a worksurface that has a waterfall edge (hidden line) or an abrupt edge (solid line)
Figure 8:
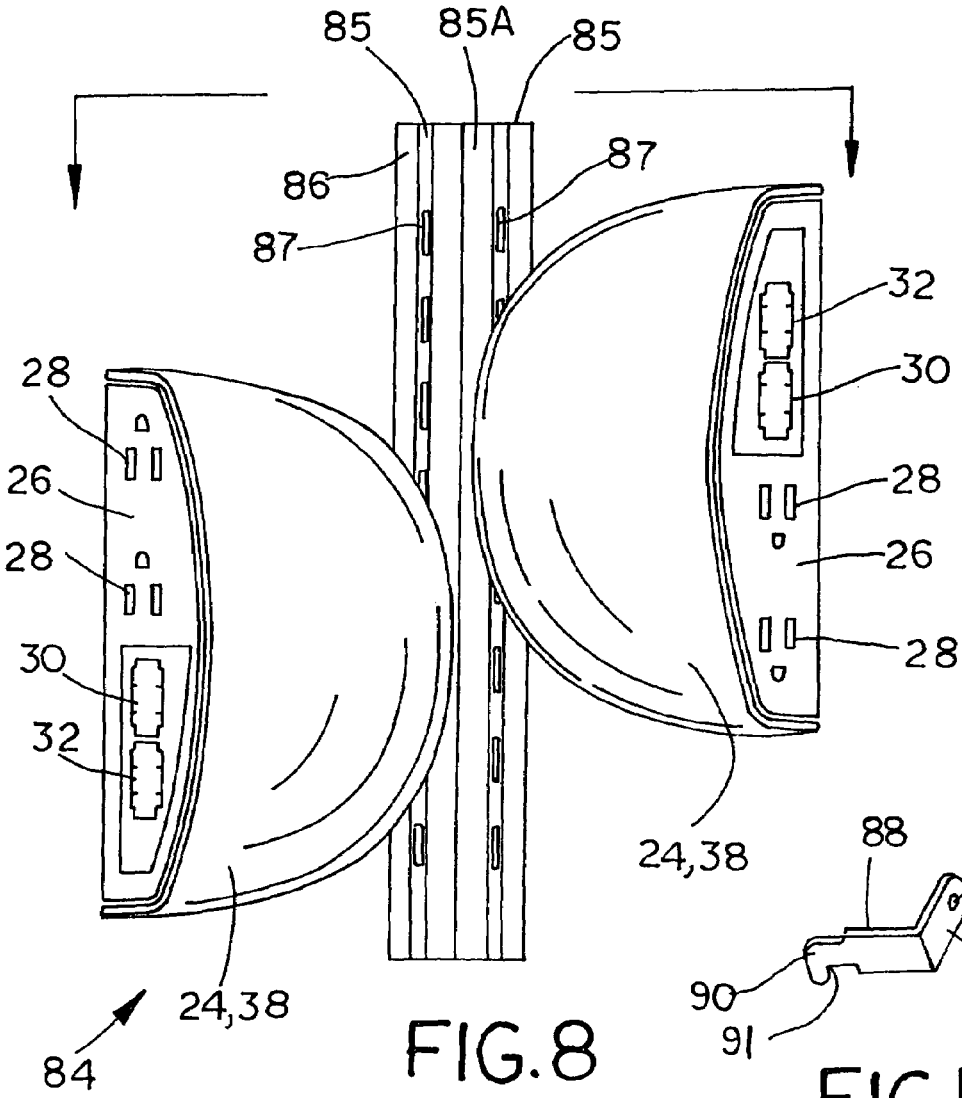
FIG. 8 is a front view of the present invention showing two modules, each mounted in apertures in a perforated slot.
Figure 10:
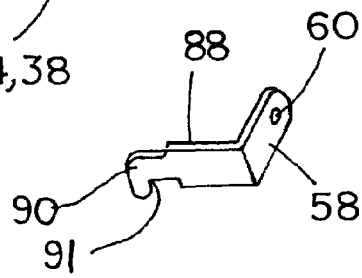
FIG. 10 is a perspective view of an embodiment of the bracket of the present invention as would be used in FIG. 8.

For example, workstation assembly 68 (FIG. 5) has electrical workstation module 24 adapted to waterfall edge 69 on worksurface 70 with opposite sides 70A and 70B. Workstation assembly 72 (FIG. 7) has electrical workstation module 24 adapted to abrupt edge 73 on worksurface 74 with opposite sides 74A and 74B. Workstation assembly 76 (FIG. 2) has electrical workstation module 24 adapted to slot 77 on worksurface 78 with opposite sides 77A and 77B. Slotted worksurface 78 requires bracket 80 (FIG. 3) with compressive segment 82 that has compressive surface 83. Workstation assembly 84 (FIG. 8) has electrical workstation module 24 (two are shown) adapted to slots 85 on worksurface 86 with perforations 87 and with opposite sides 85A and 85B. Slotted worksurface 86 requires bracket 88 (FIG. 10) with compressive segment 90 that has compressive surface 91.

In use, worksurface 22 is interposed between the bottom of electrical workstation module 24 and compressive surface 63. Knob 52 is rotated and hence movable bracket is moved relative to housing 26, which adjusts electrical workstation module 24 relative to worksurface 22. In order to hold electrical workstation module 24 stationary with respect to worksurface 22, at least a portion of worksurface 22 is compressed between movable bracket 42 and housing 26. Electrical workstation module 24 is adapted to at least one of an edge mounting, a through hole mounting and a slotted mounting.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A workstation assembly, comprising:

a worksurface having opposite sides; and an electrical workstation module, including:

a housing having a mounting surface adjacent one said side of said worksurface;

at least one modular electrical component carried by said housing;

an adjustment element in contact with said housing; and a bracket threadably connected with said adjustment element, said bracket having a compressive surface adjacent an other said side of said worksurface and facing said mounting surface, said compressive surface movable in directions toward and away from said mounting surface by rotating said adjustment element.

2. The workstation assembly of claim 1, wherein said movable bracket is connected to said worksurface.

3. The workstation assembly of claim 1, wherein said housing includes a shaped slot, said movable bracket includes a shaped segment, said shaped segment located in said shaped slot.

4. The workstation assembly of claim 1, wherein said adjustment element includes a knob, a threaded element connected to said knob and a flange connected to said threaded element.

5. The workstation assembly of claim 1, wherein said housing includes a cover.

6. The workstation assembly of claim 1, wherein said modular electrical component is one of a power receptacle, a data receptacle, and a telephone receptacle.

7. The workstation assembly of claim 1, wherein said bracket is movable relative to said housing.

8. The workstation assembly of claim 1, wherein said bracket is configured for mounting said electrical workstation module in at least one of an edge mounting, a through hole mounting and a slotted mounting.

9. A workstation assembly, comprising:

a worksurface having opposite sides; and an electrical workstation module, including:

a housing having a mounting surface adjacent one said side of said worksurface, said housing including a cover;

at least one modular electrical component carried by said housing; an adjustment element connected to said housing, said adjustment element includes a knob, a threaded element connected to said knob and a flange connected to said threaded element, said knob disposed between said housing and said cover; and a bracket connected with said adjustment element, said bracket having a compressive surface adjacent an other said side of said worksurface and facing said mounting surface, said compressive surface movable in directions toward and away from said mounting surface using said adjustment element.

10. An electrical workstation module, comprising:

a housing having a mounting surface;

at least one modular electrical component carried by said housing;

an adjustment element in contact with said housing; and a bracket threadably connected with said adjustment element, said bracket having a compressive surface adjacent facing said mounting surface, said compressive surface movable in directions toward and away from said mounting surface by rotating said adjustment element.

11. The electrical workstation module of claim 10, wherein said housing includes a shaped slot, said movable bracket includes a shaped segment, said shaped segment located in said shaped slot.

12. The electrical workstation module of claim 10, wherein said adjustment element includes a knob, a threaded element connected to said knob and a flange connected to said threaded element.

13. The electrical workstation module of claim 10, wherein said housing includes a cover.

14. An electrical workstation module, comprising:

a housing having a mounting surface, said housing includes a cover;

at least one modular electrical component carried by said housing;

an adjustment element connected to said housing, said adjustment element includes a knob, a threaded element connected to said knob and a flange connected to said threaded element, said knob disposed between said housing and said cover; and a bracket connected with said adjustment element, said bracket having a compressive surface adjacent facing said mounting surface, said compressive surface movable in directions toward and away from said mounting surface using said adjustment element.

15. The electrical workstation module of claim 10, wherein said modular electrical component is one of a power receptacle, a data receptacle, and a telephone receptacle.

16. The electrical workstation module of claim 10, wherein said bracket is movable relative to said housing.

17. The electrical workstation module of claim 10, wherein said bracket is configured for mounting said electrical workstation module in at least one of an edge mounting, a through hole mounting and a slotted mounting.

18. A method of mounting an electrical workstation module to a worksurface, comprising the steps of:

placing an electrical workstation module against the worksurface, said electrical workstation module including a housing having at least one modular electrical component, an adjustment element in contact with said housing and a movable bracket threadably connected to said adjustment element;

moving said movable bracket relative to said housing by rotating said adjustment element; and compressing at least a portion of said worksurface between said bracket and said housing.

19. The method of claim 18, further including the step of adapting mounting of said electrical workstation module to at least one of an edge mounting, a through hole mounting and a slotted mounting.

* * * * *